US005762335A

United States Patent [19]

Magruder

[11] Patent Number: 5,762,335

[45] Date of Patent: Jun. 9, 1998

[54] TWO HANDED PUZZLE HAVING A SOLUTION REQUIRING A PREDETERMINED ORIENTATION OF THE HANDS

[76] Inventor: Thomas A. Magruder, P. O. Box 785, Linville, N.C. 28646

[21] Appl. No.: 729,003

[22] Filed: Oct. 10, 1996

[51] Int. Cl.[6] ..... A63F 9/00

[52] U.S. Cl. ..... 273/153 R; 273/156; 446/327

[58] Field of Search ..... 273/153 R, 156, 273/440; 446/327, 328, 329, 99, 100

[56] References Cited

U.S. PATENT DOCUMENTS

| | | | |
|---|---|---|---|
| 222,571 | 12/1879 | Carlin . | |
| D. 366,297 | 1/1996 | Ford . | |
| 869,686 | 10/1907 | Bauno | 273/153 R |
| 926,784 | 7/1909 | Trimbur . | |
| 984,414 | 2/1911 | Black . | |
| 1,143,808 | 6/1915 | Choate . | |
| 1,417,860 | 5/1922 | Reich | 446/327 |
| 1,437,406 | 12/1922 | Druzbach . | |
| 1,641,175 | 9/1927 | Lemieux | 446/327 |
| 2,546,209 | 3/1951 | Baum . | |
| 2,729,024 | 1/1956 | Guttmann | 446/327 |
| 2,756,448 | 7/1956 | Werbe | 446/327 |
| 2,852,885 | 9/1958 | Mayer . | |
| 3,611,628 | 10/1971 | Noble et al. | 446/327 |
| 3,942,283 | 3/1976 | Rushton . | |
| 5,322,465 | 6/1994 | McGill | 446/327 |
| 5,354,226 | 10/1994 | Ruppert . | |

*Primary Examiner*—Steven B. Wong
*Attorney, Agent, or Firm*—Cumpston & Shaw

[57] ABSTRACT

A puzzle toy including an arrangement of puzzle elements attached to hand engagement structures for locating the puzzle elements with respect to the hands in an unsolved puzzle orientation, such that upon placing the hands in a predetermined orientation a puzzle solution is achieved.

20 Claims, 8 Drawing Sheets

FIG. 1A
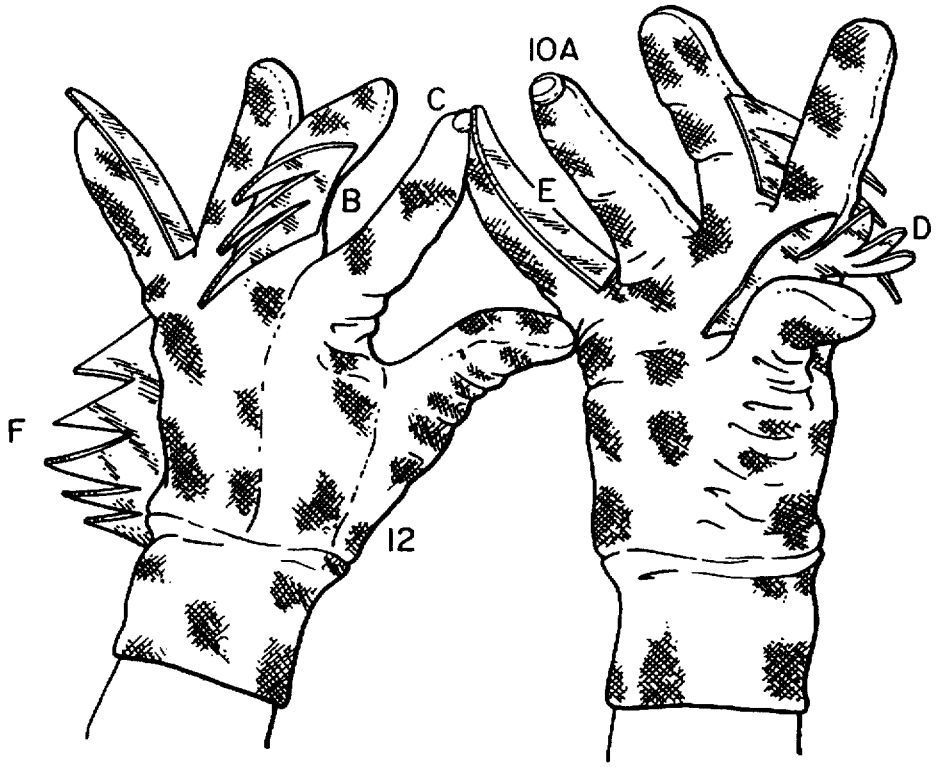
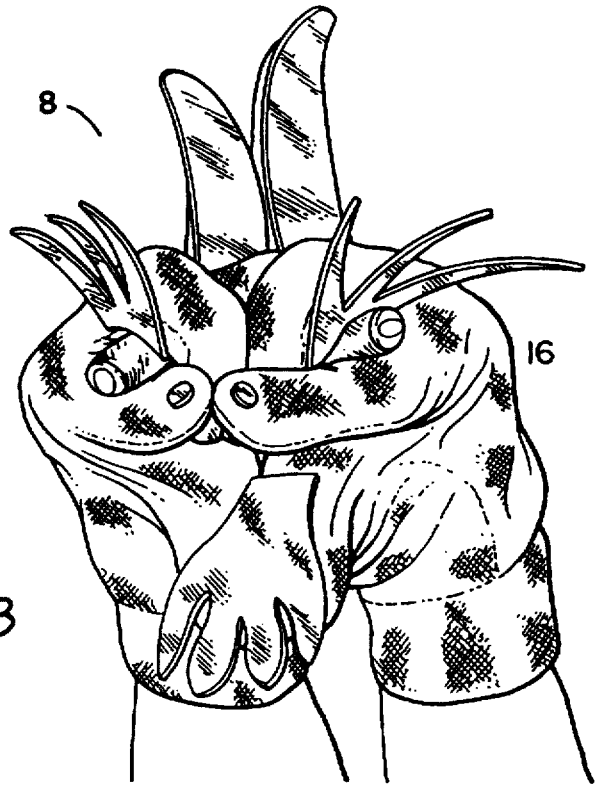
FIG. 1B

FIG. 4A
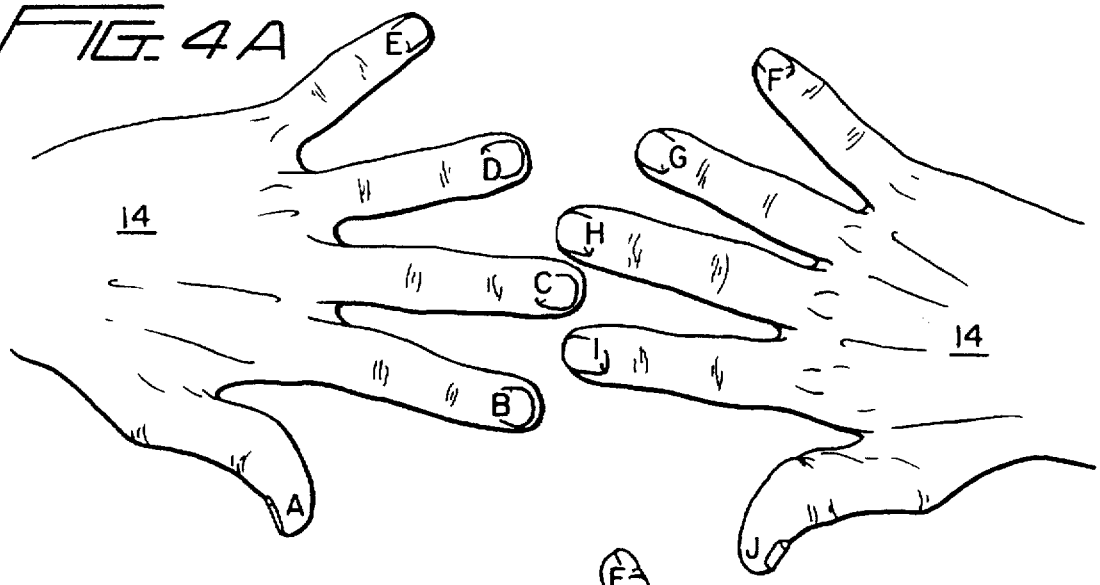
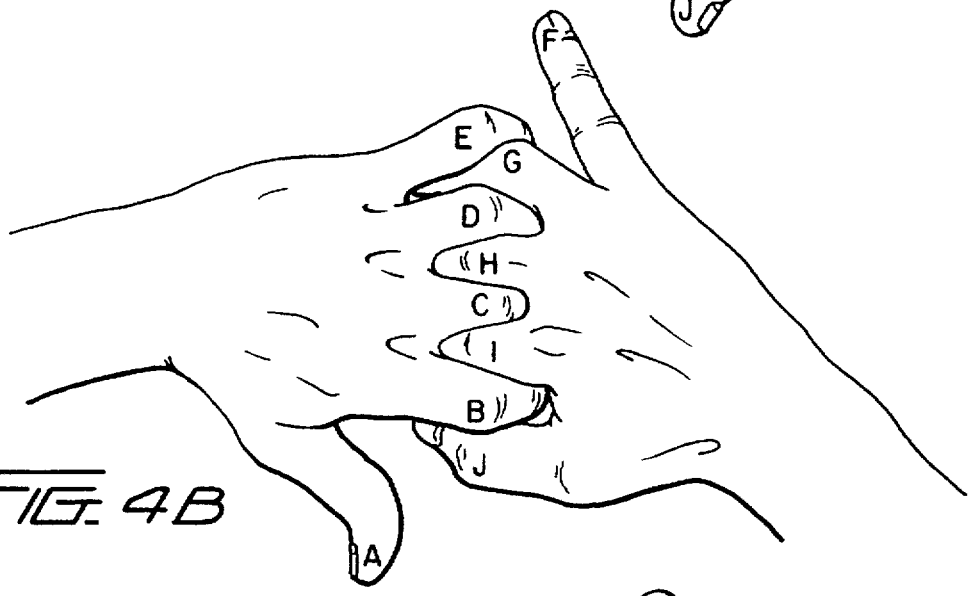
FIG. 4B
FIG. 4C
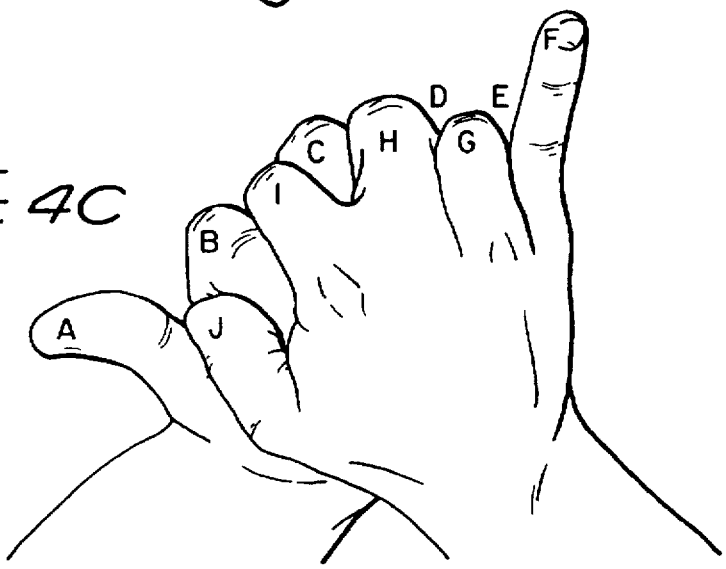

FIG. 5A
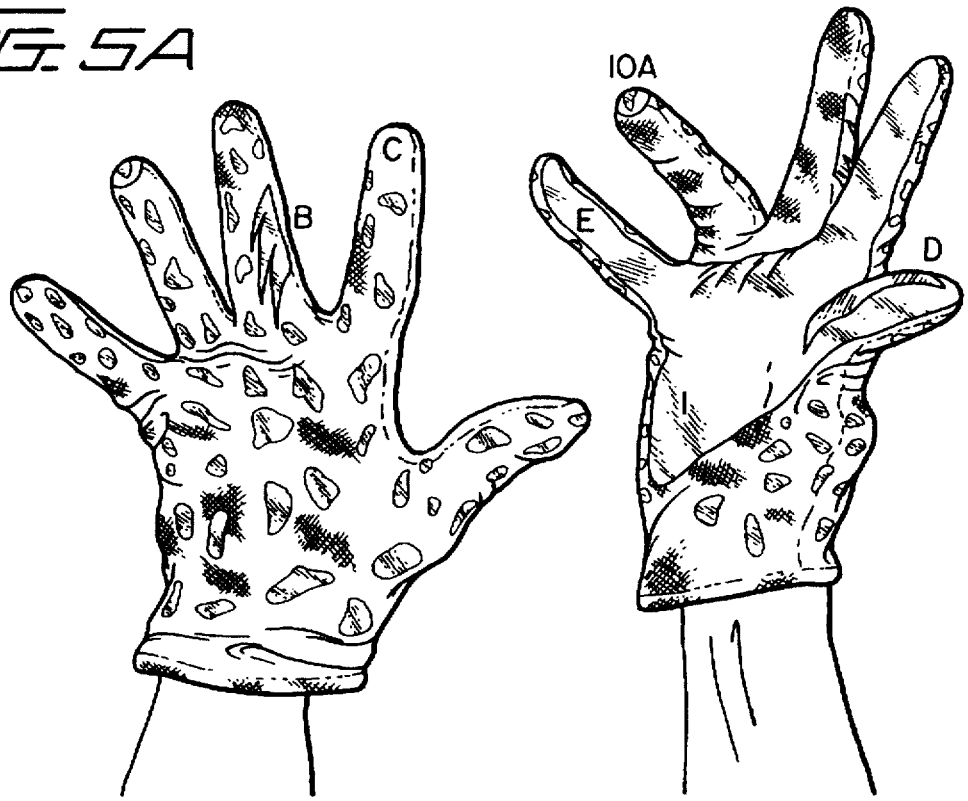
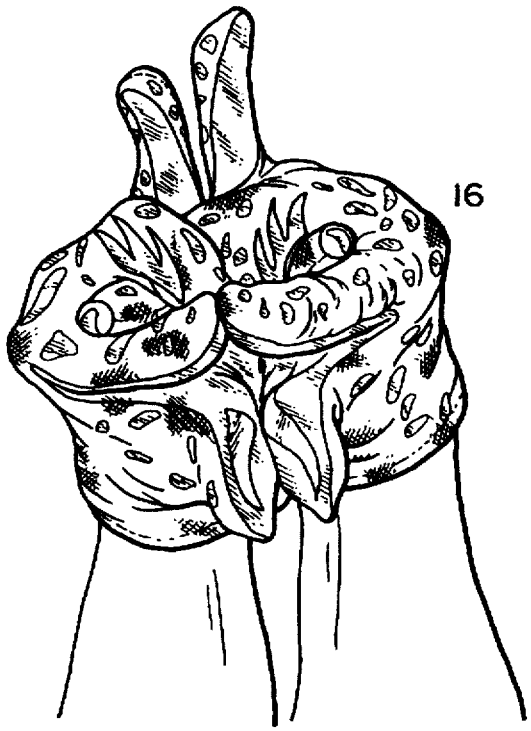
FIG. 5B

TWO HANDED PUZZLE HAVING A SOLUTION REQUIRING A PREDETERMINED ORIENTATION OF THE HANDS

FIELD OF THE INVENTION

The present invention relates to puzzle and puppet toys, and more particularly to an amusement device having an arrangement of puzzle parts that releasably attach to the hands for the purpose of presenting a puzzle to be solved through the discovery of a given orientation of the hands and disposing the hands in the predetermined orientation to obtain the solution to the puzzle.

BACKGROUND OF THE INVENTION

Puppets designed to be worn on hands have been a popular means of amusement and entertainment. U.S. Pat. No. 222,571 entitled "Toy Dancer" to Carlin discloses a puppet worn on hands with insertion sockets that accept user fingers thereby permitting character animation. This design was simplified in U.S. Pat. No. 2,546,209 to Baum, which discloses a novelty glove with animated figures attached, that permit movement of glove fingers to simulate character animation. Although the puppets of Carlin and Baum are simple and functional, they permit only partial animation of characters.

Additionally, the flat, single dimensional like quality of these characters lacks a three dimensional, life-like appearance. That is these devices do not provide a front, back, top and sides of a character. The novelty of such simple animated glove figures soon falls short in the hands of a child or adult.

Another style of puppet design is shown in U.S. Pat. No. 926,784 to Trimbur, and U.S. Pat. No. 984,414 to Black, U.S. Pat. No. 1,143,808 to Choate, and U.S. Pat. No. 1,437,406 to Druzbach. These constructions provide an animated human face on the back of a closed hand, allowing the hand itself to form some of the multi-dimensional quality of the character face, and thereby reducing production cost. But the designs of Trimbur and followers share the shortcomings of a limited single hand animation and narrow range of characterization. Additionally, the designs do not significantly challenge a user both mentally and physically nor provide high user stimulation.

A trend in puppet manufacture has been the construction of animated multi-dimensional stuffed toy characters. These stuffed toys are built to include a hand receptacle which accepts a hand and permits the animation of multiple appendages of a character. U.S. Pat. No. 3,942,283 to Rushton, illustrates this type of configuration.

While the stuffed puppet construction may produce life-like characters, it comes at the high cost of complexity in manufacture. Each additional life-like feature requires additional complex sewing procedures and extensive use of fabrics and materials. Complexity is reflected in the cost of each stuffed toy puppet. Such high dollar dolls often end up on display rather than in use, exciting and educating the mind of a child.

In U.S. Pat. No. 5,354,226 to Rupert, a pair of spheroid eyes joined together and attached to a finger by a cord is disclosed. U.S. Des. Pat. No. 366,297 to Ford shows a similar design.

The simplification represented by these recent designs has produced puppets which are relatively inexpensively made and sold within the price range of the mainstream population. Yet the low cost and complexity of the designs has resulted in a loss of life-like nature of the characters. The designs often produce characters indistinguishable as a particular creature.

Current puppets retain a number of problematic areas including characters that are immediately recognizable when initially observed, therefore if audience suspense is to be created a stage curtain is required. That is, the one time immediate identity and animation of the character or puppet are the only novelties offered. Many available hand puppet designs do not significantly challenge the mind and body of the user simultaneously. This lack of interaction results in monotony of play. Many existing designs permit the creation of only a narrow range of characters, or species of characters. Existing designs do not enhance body awareness nor afford a comprehensive application to the fields of mental/physical therapy. Existing designs do not encourage group interaction where two or more users contribute to a character's creation and animation.

Therefore, the need exists for a hand puzzle device that offers solutions to these problems as well as provides more than simple animated uni-dimensional puppet characters that do not capture and hold the attention of high need users. The need also exists for such devices that do not require complex and expensive construction techniques of multi-dimensional stuffed toy puppet characters. A further need exists for a puzzle puppet device that results in life-like characters having a three dimensional quality, while teaching a user animation as well as problem solving skills. The need still exists for characters that are not generally recognizable until a solution of the puzzle is achieved.

SUMMARY OF THE INVENTION

The present invention includes a puzzle toy for manipulation by a pair of hands having a plurality of digits, the puzzle toy including a first hand engaging structure for releasably engaging at least a portion of the digits of a first hand; a first arrangement of puzzle members connected to the first engaging structure; a second hand engaging, structure for releasably engaging at least a portion of the digits of a second hand engaging structure; a second arrangement of puzzle members connected to the second hand engaging structure; first and second arrangements of puzzle members disposed on the respective first and second hand engaging structure selected to present an unsolved puzzle upon initial engagement with the hands and forming a recognizable puzzle solution upon the placement of the first and second hands in a predetermined orientation.

The present invention thus offers several advantages and meets many objects including: providing a hand puzzle in a puppet design of great simplicity that also produces characters that highly stimulate the user both intellectually and physically; providing a hand puzzle in a puppet design that allows production of multi-dimensional characters without requiring the complex and costly manufacturing techniques common to stuffed toy puppet production. The invention also provides a hand puzzle in a puppet design of modern simplicity and low cost which also permits the creation of life-like characters, having faces, tops, sides and backs of the heads and portions of the body. A hand puzzle in a puppet design that is multi-use, combining the best aspects of an animated puppet with a challenging puzzle, wherein character identity may be initially hidden, thereby eliminating the need for a formal stage curtain.

A hand puzzle in a puppet design where multiple novelty features enhance the stimulation of the user and encourage variation in play and will substantially challenge both the mental and physical capacities of a user simultaneously to enhance body awareness and serve as an effective tool in the fields of education and therapy is also provided. The present invention also invites group interaction by permitting two or more users to create joint puppet characters, as well as permit the creation and animation of an unlimited range of character types and species. A puppet puzzle glove design which will double as functional outdoor wear or sportswear to protect hands in inclement weather.

Further objects and advantages are to provide a hand puzzle in a puppet design producing the high intrigue of a puzzle to be solved by a puzzler. Puzzlers are not generally versed in the art of puppetry, nor are puppeteers in that of puzzlery. Therefore, the present invention puzzle toy puppet bridges two formerly separate fields of art. This permits flow of more variation, imagination, and innovation between fields. Still further objects and advantages will become apparent from a consideration of the ensuing description and drawings.

BRIEF DESCRIPTION OF THE DRAWINGS

In the drawings, closely related figures and related parts have the same number but different alphabetic suffixes.

FIG. 1A shows a dragon embodiment of the puzzle toy in an unsolved configuration.

FIG. 1B shows the dragon embodiment of the puzzle toy in a solved configuration.

FIG. 4A shows a first step in the solution orientation to solve the stegosaurus configuration puzzle.

FIG. 4B shows a second step in the solution orientation to solve the stegosaurus configuration puzzle.

FIG. 4C shows a third step in the solution orientation to solve the stegosaurus configuration puzzle.

FIG. 5A shows a third embodiment of the puzzle in an unsolved configuration.

FIG. 5B shows the third embodiment of the puzzle in a solved configuration.

DETAILED DESCRIPTION OF THE PREFERRED EMBODIMENTS

Figure 2A:
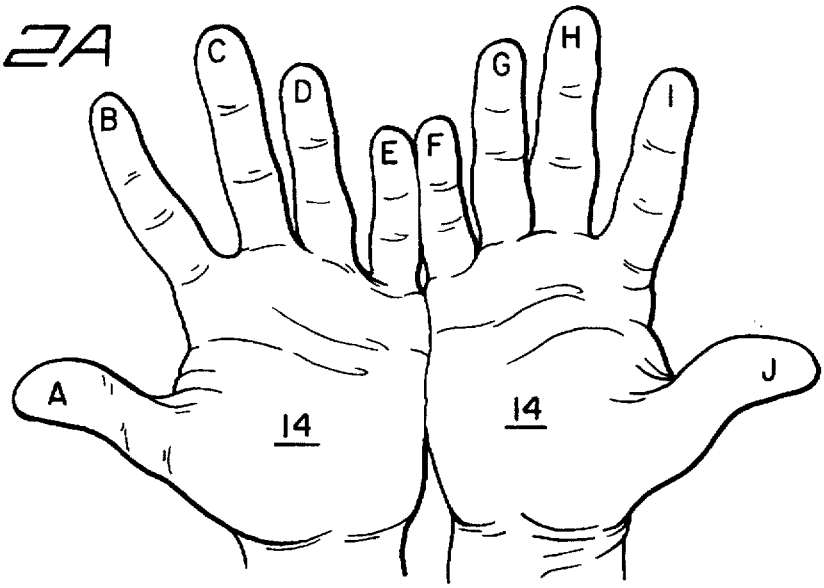
FIG. 2A shows a first step in the solution orientation to solve the dragon configuration puzzle.

In accordance with the present invention, a puzzle toy 8 includes puzzle elements 10 and hand engaging structures 12. The hand engaging structures 12 and puzzle elements 10 are selected and disposed upon each hand 14 in a predetermined pattern so that upon the hands being disposed in a predetermined solution orientation a puzzle solution 16 is achieved. The solution orientation may require a combination of interlacing, interweaving, intertwining, interlocking, hooking, abutting or aligning flush the fingers from two hands 14. Preferably, when the puzzle solution is achieved, the puzzle elements 10 form a readily apparent relationship. That is, the puzzle elements 10 have a predetermined relationship in the puzzle solution. When the hands 14 are in an open, relaxed position and the puzzle elements 10 are disposed on the hands, the puzzle elements seem "randomly" positioned and provide few clues about their relationship in the puzzle solution.

An embodiment of the puzzle toy 8 in a hand puppet embodiment is illustrated in FIG. 1A in an unsolved configuration and in FIG. 1B in a solved configuration.

The puzzle toy 8 includes puzzle elements 10A–F designed to simulate anatomical features of a desired character, such as eyes, eyebrows, nostrils, tongues, horns, scales, plates, tails, teeth, feathers, whiskers, antennae, ears, claws, fins, etc. Puzzle elements 10 may be fashioned out of any suitable flexible or rigid material, such as foam, plastic, paper, fabric, feathers, hair, leather, wood, metal, or composites.

The hand engagement structure 12 is releasably engaged with the hands 14 of a user. The hand engagement structure 12 may be in the form of a glove, rings, sleeves, clips or adhesives. The hand engagement structure 12 permits the puzzle elements 10 to be disposed on the hands 14. As shown in FIGS. 1A, 1B, 3A, 3B, 5A and 5B the hand engagement structure 12 is a glove. The glove may be any flexible seamable material such as cloth, plastic, vinyl, leather, Tyvek®, and poly fiber, or a thermo-moldable material such as plastic, latex, or rubber. Depending upon the material of the hand engagement structure 12 and the puzzle, the puzzle elements 10 may be integrally formed with the hand engagement structure. Integral puzzle elements 10 and hand engagement structures 12 are shown in FIGS. 5A and 5B.

Puzzle elements 10 may be secured to hand engagement structures 12 in a variety of ways, such as hot melt glue, adhesives, embroidery, heat lamination, snaps buttons, Velcro®, and decals. The puzzle elements 10 are affixed to the hand engagement structures 12 in apparently random locations upon the hand engagement structure 10 being disposed on the hand 14. The location of the puzzle elements 10 on the hands 14 when the hands are in a non solution or non interlocking relation appears to be substantially random. However, the specific locations of the puzzle elements 10 are such that they require two hands to be in the solution orientation to dispose the puzzle elements in the puzzle solution 16.

Figure 6A:
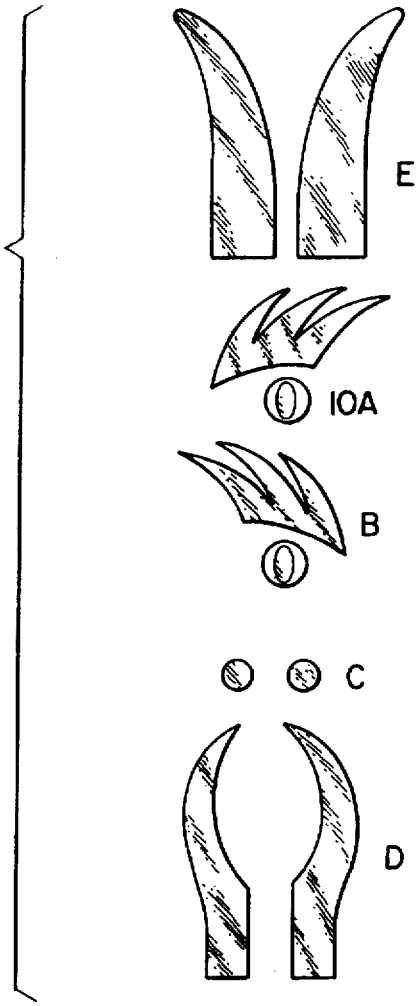
FIG. 6A shows a fourth embodiment of the puzzle in an unsolved configuration in an unattached decal puzzle presentation.
Figure 6B:
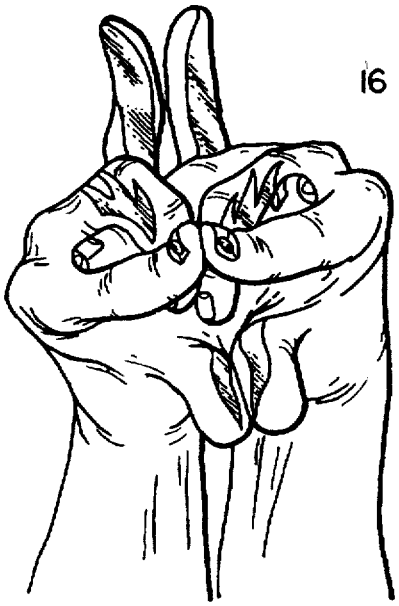
FIG. 6B shows the fourth embodiment of the puzzle in a solved configuration in an attached decal puzzle presentation.
Figure 7A:
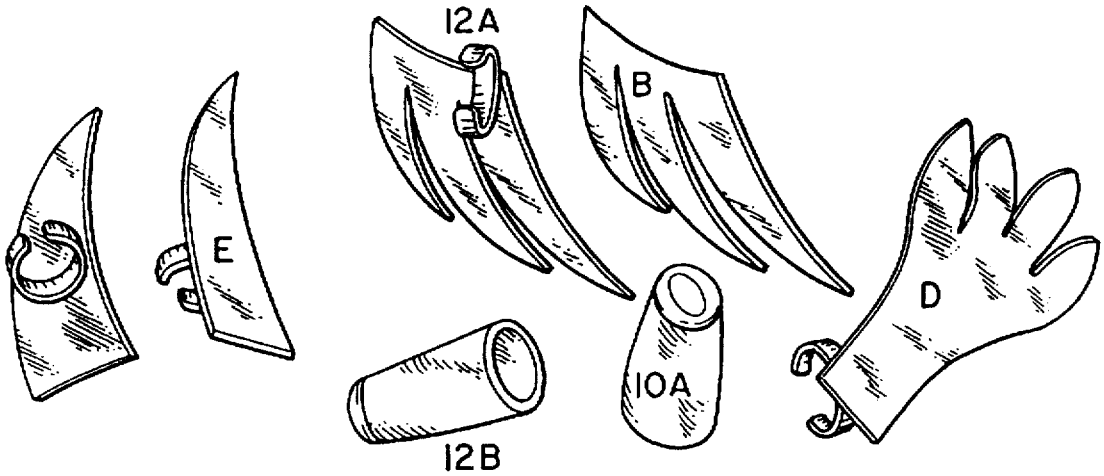
FIG. 7A shows a fifth embodiment of the puzzle employing alternative hand engaging structures in an unsolved and unattached position.
Figure 7B:
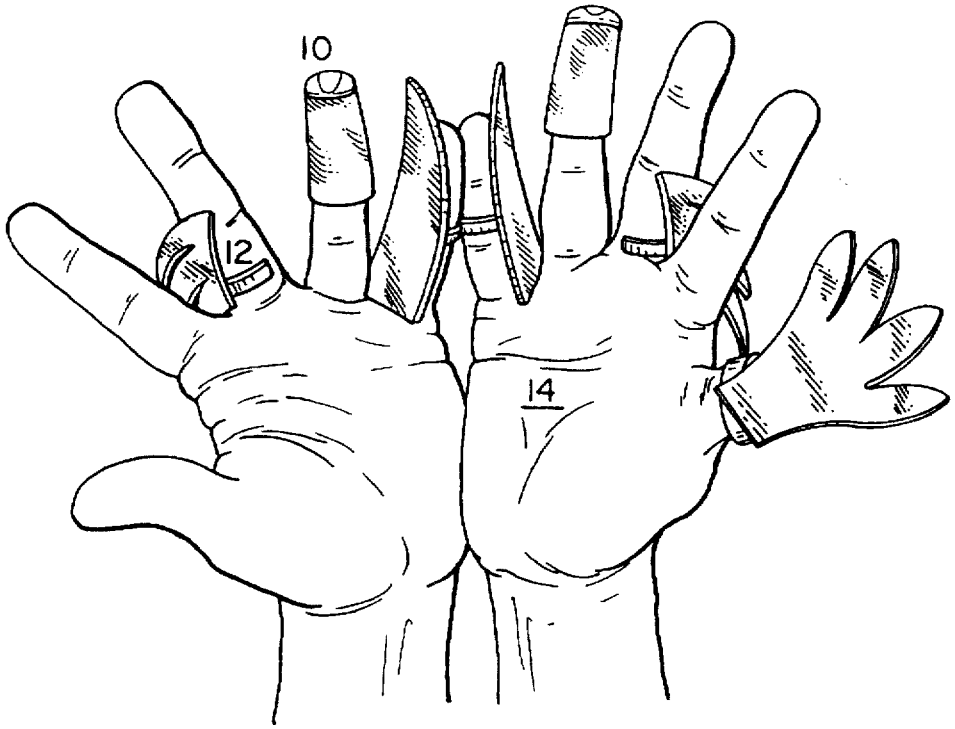
FIG. 7B shows the fifth embodiment of the puzzle employing the alternative hand engaging structures in an unsolved and attached position.
Figure 7C:
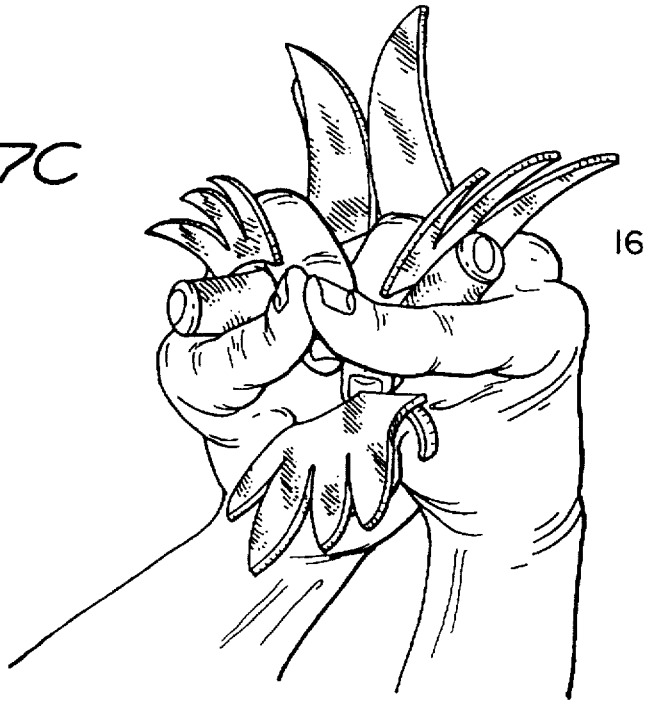
FIG. 7C shows the fifth embodiment of the puzzle employing the alternative hand engaging structures in a solved and attached position.

There are various possibilities with regard to the relative configuration and construction of puzzle elements 10 and hand engagement structures 12 as indicated in further embodiments illustrated in FIGS. 5, 6 and 7. These embodiments are not meant to be construed as departures from the spirit of the original invention, but rather as continuations which extend the scope of the invention and expand its application and utility.

FIGS. 5A and 5B show an additional embodiment of the invention, particularly, the puzzle elements 10 being integral with the hand engagement structures 12. In this embodiment, a hand engagement structure 12 is configured in a form of a glove having puzzle elements 10A–E integrally affixed. The connection may include a variety of common ways, such as screen printing, air brushing, painting, dyeing, or decaling onto the surface of the hand engagement structures 12. It is understood the integral connection of the puzzle elements 10 and hand engagement structures 12 includes those connections that preclude non destructive separation of the components.

Other mechanisms of connection include those employed in fabric glove making, such as sewing, quilting, weaving, iron-on patching, applique, fabric panel layout, and needlepoint. Still additional ways of integral connection of puzzle elements 10 to hand engagement structures 12 include thermo-injection molding of parts from a suitable material, such as plastic, rubber, or latex, as in the technology used to produce costume masks. In this last instance, the shape, color, and predetermined placement of members 10 would be precisely incorporated into the design of the production mold for each variation of puzzle toy 8.

FIGS. 6A and 6B illustrate a further embodiment of the invention and particularly adhesive decal puzzle members 10. In this embodiment, puzzle members 10A–E are decals which incorporate a hand engagement structure 12 in the form of a skin releasable adhesive. Puzzle elements 10 are worn on hands 14 subject to the predetermined puzzle pattern required to form the solved puzzle 16. Pressure sensitive decals made of materials, such as plastic, foil, fabric, or paper may be backed with an adhesive compound. Additionally, unbacked plastic decals may incorporate the adhesion principle of water surface tension such as is common to reusable "bathtub letter and symbol" decals. Temporary tattoo decal may also be employed as the puzzle elements with respect to the hands 14. That is, these decals include an image representing the puzzle element and a substrate for engaging the hand. These puzzle elements 10 are thereby substantially directly affixed to the skin of the hand 14.

FIGS. 7A and 7B illustrate a further embodiment of the invention, and particularly hand engagement structure 12 in the form of rings and caps, wherein the puzzle elements 10 are separately formed or are integral with the hand engagement structure. This embodiment includes puzzle elements 10A, 10B, 10D, and 10E employing a hand engagement structure 12 having finger rings 12A and finger caps 12B.

Independent of the particular embodiment, the puzzle elements 10 may be constructed as (a) integral portions of hand engagement structure 12; (b) independent components separate from and removably joined to hand engagement structure; or (c) separate from and permanently joined to hand engagement structure. In any such embodiment, placing the hands 14 with puzzle elements 10 in the predetermined solution orientation results in a solved puzzle 16.

When the puzzle elements 10 are formed as integral portions of the hand engagement structure 12, the puzzle elements may be injection molded or machined from a suitable flexible or rigid material, such as rubber or plastic to form an integral puzzle element and hand engagement structure 12 having finger rings 12A and finger caps 12B. Alternatively, puzzle elements 10 and hand engagement structure 12 may integrally formed by being die cut or punched from a suitable flexible material, such as foam, plastic, paper, cardboard, or leather in such a way as to leave tabs which may be bent and interlocked, as in the technology common to paper doll construction, to form finger rings and finger caps, as shown in FIGS. 7A and 7B. The integral puzzle elements 10 and hand engagement structure 12 in each above instances are subsequently releasably attached to hands 14 subject to the solution orientation to create a puzzle solution 16 such as an animated character.

In the embodiments employing independent puzzle elements 10 separate from and removably joined to hand engagement structure 12, the puzzle elements may employ similar materials and manufacture as in the integral embodiments. However, in these embodiments, a single set of finger rings 12A and finger caps 12B may be used with a variety of attachable puzzle elements 10 to produce a puzzle solution. These embodiments lend themselves to being disposed in a plurality of various unsolved locations which in turn provide corresponding solutions.

In the embodiments having the puzzle elements 10 formed separate from, but permanently attached to hand engagement structure 12, the permanent attachment may be achieved by an adhesive or thermo-molding process. Other suitable materials similar to those stated above may be employed in the construction of puzzle elements 10 and means 12. This instance may prove more viable in small scale or individual manufacture where the cost of molding or die cutting parts is prohibitive.

Figure 2B:
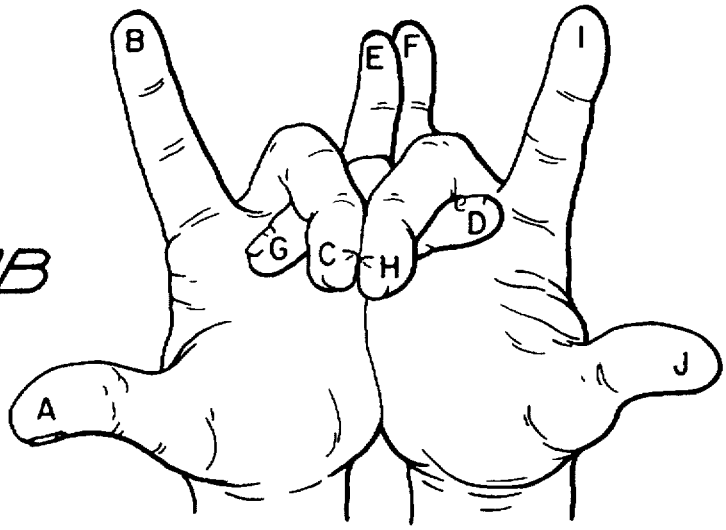
FIG. 2B shows a second step in the solution orientation to solve the dragon configuration puzzle.
Figure 2C:
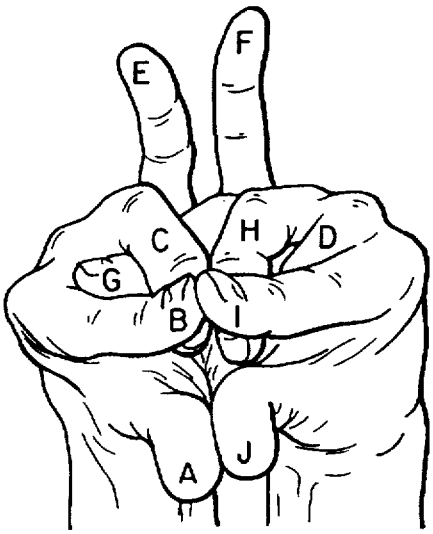
FIG. 2C shows a third step in the solution orientation to solve the dragon configuration puzzle.

FIGS. 2A, 2B and 2C illustrate a step by step process to obtain the puzzle solution by disposing the hands 14 in the solution orientation. In FIGS. 2A, 2B and 2C, the puzzle solution results in a dragon puppet character. As with all the embodiments of the invention, the solution requires the interlocking or manipulation of the hands 14 in a solution orientation, such that the solution orientation of the hands in combination with the location of the puzzle elements 10 results in the puzzle solution. In the first step shown in FIG. 2A, the hands 14 are held open with pinkie fingers 14E and 14F side by side and touching. In the second step shown in FIG. 2B, ring fingers 14D and 14G are crossed close to the base and extended diagonally to form a 90 degree angle or "V." Middle fingers 14C and 14H are then tucked together down through the "V" to form the dragon's eye sockets. In the completion step shown in FIG. 2C, index fingers 14B and 14I are held straight and brought tip to tip under the ring fingers 14D and 14G to from a point and complete the bridge of the dragon's mouth. Lastly, thumbs 14A and 14J are brought together forming the moveable lower jaw of the dragon character. Thus, following the steps of the solution orientation with the puzzle elements 10 attached on hands 14 by hand engagement structures 12 creates a solved puzzle 16.

Figure 3A:
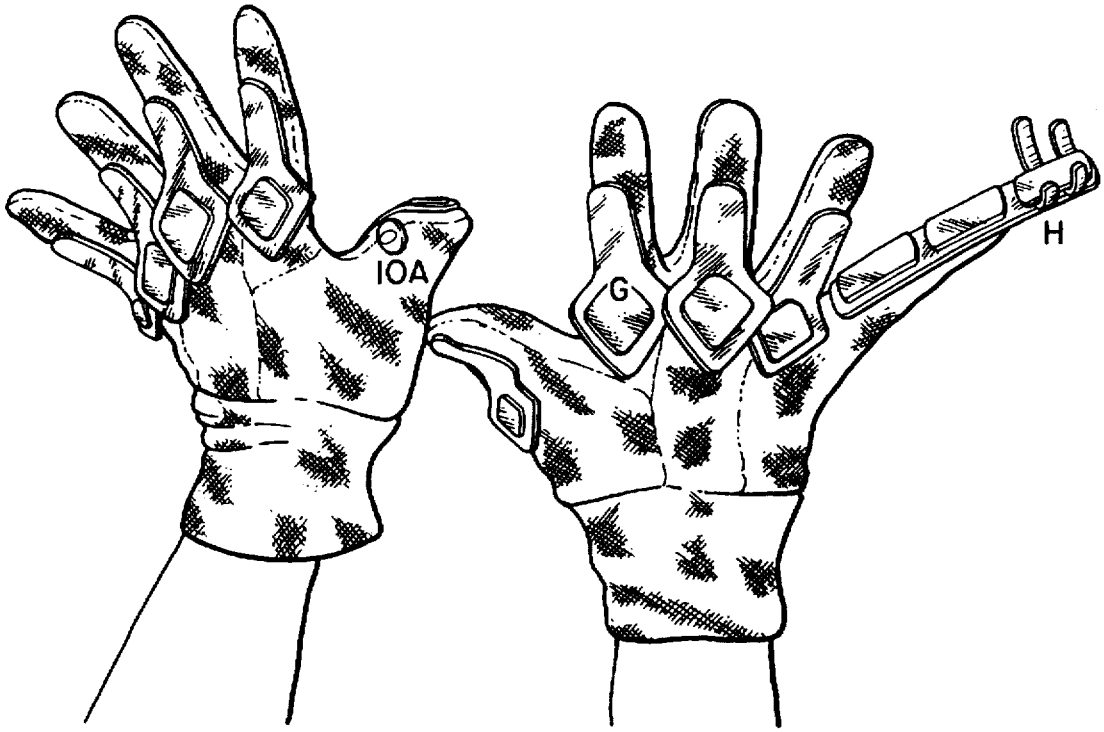
FIG. 3A shows a stegosaurus embodiment of the puzzle toy in an unsolved configuration.
Figure 3B:
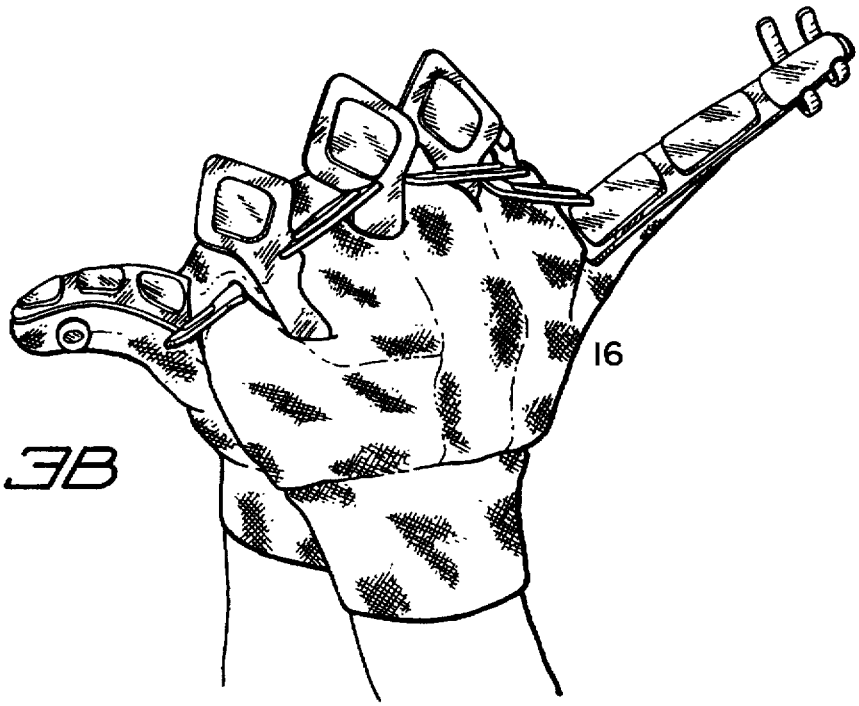
FIG. 3B shows the stegosaurus embodiment of the puzzle toy in a solved configuration.

FIG. 3 illustrates a puppet character embodiment including a stegosaurus, shown unsolved in FIG. 3A and solved in FIG. 5B. Puzzle elements 10A, G, and H simulate the dinosaur's eyes, plates, and spiked tail. The creation of the stegosaurus embodiment is accomplished by simply altering the shape and location of the puzzle elements 10 on the hand engagement structures 12 with respect to hands 14. The solution orientation and puzzle element 10 location may also be modified as necessary to create a life-like solved puzzle 16 character. Generally, the most distinguishing anatomical features of a particular solution or character will be simulated in the design of puzzle elements 10. It is anticipated by the inventor that an unlimited variety of human, animal, plant, insect, alien, dinosaur, robot, inanimate object, and fictitious solved puzzle 16 characters may be constructed by employing the art of the present invention.

FIG. 4 illustrates the step by step solution to the puzzle toy 8 by showing the particular manipulation of the hands 14 to provide the solution orientation for the puzzle in the stegosaurus embodiment. In the first step, shown in FIG. 4A, the hands 14 are positioned back side up with spread fingers pointing tip to tip. In the second step, shown in FIG. 4B, the fingers of the hands 14, excepting the left thumb 14A and right pinkie 14F mesh, rights under lefts, up to the center joint of each finger. In the completion step, shown in FIG. 4C, the palms of the hands 14 are brought together arching the joints of the meshed fingers 14B, 14C, 14D, 14E,14 G, 14H, 14I, and 14J upward. The left thumb 14A is overturned to simulate the moveable head of the stegosaurus. The right pinkie 14F may be swung to and fro to simulate the tail. Thus, as before, following the steps to achieve the solution orientation of the hands 14 with puzzle elements 10 attached on hands by hand engagement structures 12 creates a solved puzzle 16.

It is further contemplated that for beginners or young users, a picture of the puzzle solution may be referred to upon engagement of the hand engagement structure 12 with the respective hand 14 and location of the puzzle elements 10 with respect to the hands. The young, users is thus provided a goal (the solution) and must manipulate their hands 14 in a cooperative manner to place the hands in the solution orientation and create the pictured solution.

Alternatively, teams may be established, wherein each member of a team of two uses one of the hand engagement structures 12. Each team is presented a picture of the solution and the first team to achieve the solution wins. This game may be further modified by requiring the teams to solve the respective puzzle with the assistance of a solution picture.

In the creation of a puzzle, the hands 14 are initially interlocked in a reproducible orientation. This orientation becomes the solution orientation that must be reconstructed by users to solve the puzzle. Preferably, the solution orientation requires independent combinations of interweaving, intertwining, abutting, aligning, flush aligning and/or hooking with respect to the ten digits of a user. Once the hands 14 are in the desired solution orientation, a plurality of puzzle elements 10 are each assigned to specific locations on the interlocked hands to represent a puzzle solution. That is, the puzzle solution is created about the hands 14 in the solution orientation. The hands 14 are then disengaged. The individual puzzle elements 10 are then attached in the assigned locations with respect to the hands by the hand engagement structures 12.

Accordingly, the present invention creates a bridge between the fields of puppetry and puzzlery effectively enhancing the art of each field with that of the other. The puzzle toy 8 requires a user to deduce what the puzzle solution could or should be, then construct the necessary solution orientation of the hands 14. In addition, it permits the construction of stimulating life-like multi-dimensional puppet characters with less materials and expense than previous attempts. Such simplicity also permits small scale craft enthusiasts and individual builders to create professional quality puppets using common materials. Further, the novelty and fun factors of the puzzle are increased. Its characteristics for both physical and mental challenge permit application to the fields of physical and mental rehabilitative therapy. And by teaching body awareness, the puzzle puppet device may serve as useful tool in the education of children in their formative years. Furthermore, the puzzle puppet design has the additional advantages in that it initially conceals the solution (character identity) and eliminates a need for a formal stage curtain. The invention also it provides for the creation of a wide variety of solutions embodying different characters without sacrificing quality, simplicity, or economy. The invention also encourages self engagement and independence by inviting a user to intimately concentrate on the creation of the solution characters. When employed with multiple users, the invention encourages group interaction and interdependence by inviting the multiple players to bond in the creation of solution characters. In addition, the invention permit a variety of methods of manufacture, such as disposable decals, which will fit the smallest of budgets.

Although the description above contains many specifications, these should not be construed as limiting the scope of the invention, but as merely providing illustrations of some of the presently preferred embodiments my invention may encompass. Thus, the scope of the invention should be determined by the appended claims and their legal equivalents, rather than by the examples given.

I claim:

1. A puzzle toy for manipulation by a pair of hands having a plurality of digits, comprising:

(a) a first hand engaging structure for releasably engaging at least a portion of the digits of a first hand;

(b) a first arrangement of puzzle elements connected to the first hand engaging structure;

(c) a second hand engaging structure for releasably engaging at least a portion of the digits of a second hand engaging structure;

(d) a second arrangement of puzzle elements connected to the second hand engaging structure;

(e) the first and second arrangements of puzzle elements disposed on the respective first and second hand engaging structures selected to present an unsolved puzzle upon initial engagement with the hands and forming a puzzle solution upon interdigitation of the first and second hands in a predetermined orientation.

2. The puzzle toy of claim 1, wherein the first and the second hand engaging structures are a pair of gloves at least partially enclosing the digits of the hands.

3. The puzzle toy of claim 2, wherein the puzzle elements are integral with the hand engaging structures.

4. The puzzle toy of claim 1, wherein the puzzle elements are integral with the hand engaging structures.

5. The puzzle toy of claim 1, wherein the hand engaging structures include an adhesive.

6. The puzzle toy of claim 1, wherein the hand engaging structures at least partially encircle the digits of the hands.

7. The puzzle toy of claim 1, wherein puzzle elements are tattoos.

8. The puzzle toy of claim 1, wherein the puzzle solution comprises an animated puppet character.

9. The puzzle toy of claim 8, wherein the puppet character comprises at least a partial face.

10. The puzzle toy of claim 9, wherein the character comprises at least a partial body.

11. A three dimensional hand sculpture for releasable engagement with the fingers of two hands to form a three dimensional sculpture, comprising:

(a) a plurality of sculptural elements adapted to be disposed on the individual fingers of the hands, each hand including sculptural elements of the three dimensional sculpture, each of the puzzle elements forming a portion of the three dimensional sculpture that is achieved when the fingers of both hands are arranged in a solution orientation.

12. The three dimensional hand sculpture of claim 11 further comprising a glove and the puzzle elements are attached to the glove.

13. The three dimensional hand sculpture of claim 12, wherein the glove includes finger portions and the puzzle elements are attached to the finger portions.

14. A method of forming a hand puzzle for a pair of hands, comprising:

(a) interdigitating a first and a second hand in a reproducible solution orientation;

(b) assigning a plurality of puzzle elements to specific locations on the interdigitated hands to represent a puzzle solution;

(c) disengaging the first and the second hands; and (d) disposing the puzzle elements with respect to the first and the second hands at the specific locations to create an unsolved puzzle.

15. A method of creating a hand puzzle, comprising:

(a) disposing a plurality of puzzle elements on the hands of a user in a non interdigitated orientation; and (b) interdigitating the hands in a solution orientation to produce a solution to the hand puzzle.

16. The method of claim 15, wherein disposing the plurality of puzzle elements includes disposing the elements on hands of a plurality of users.

17. A hand puzzle for releasable engagement with the fingers of two hands, comprising:

(a) a visual representation of a puzzle solution; and (b) a plurality of puzzle elements adapted to be disposed on the individual fingers of the hands, a portion of the puzzle elements disposed on a first hand and a remaining portion of the elements disposed on a second hand, each of the puzzle elements forming a portion of a three dimensional sculpture that is achieved when the fingers of both hands are interdigitated in a solution orientation.

18. The hand puzzle of claim 17, wherein the visual representation of the puzzle solution is a picture.

19. The hand puzzle of claim 17, further comprising hand engaging structure for releasably engaging the hand, the puzzle elements connected to the hand engaging structure.

20. The three dimensional hand sculpture of claim 11, wherein the solution orientation requires interdigitation of the hands.

* * * * *